US006042718A

United States Patent [19]

Bland et al.

[11] Patent Number: 6,042,718

[45] Date of Patent: Mar. 28, 2000

[54] PROCESS FOR REMOVING WATER FROM A WATER-CONTAINING CRUDE OIL

[75] Inventors: Linden H. Bland, Edmonton; Edward E. Brauer, Lloydminster, both of Canada

[73] Assignee: Universal Industries Corp., Lloydminster, Canada

[21] Appl. No.: 08/977,872

[22] Filed: Nov. 25, 1997

[30] Foreign Application Priority Data

Nov. 29, 1996 [CA] Canada ..... 2191684

[51] Int. Cl.[7] ..... C10G 33/00; C07C 51/44

[52] U.S. Cl. ..... 208/187; 203/14

[58] Field of Search ..... 208/187; 203/14

[56] References Cited

U.S. PATENT DOCUMENTS

| | | | |
|---|---|---|---|
| 3,453,205 | 7/1969 | Francis et al. | 208/187 |
| 4,789,461 | 12/1988 | Clare et al. | 208/187 |
| 5,707,510 | 1/1998 | Berry | 208/184 |

FOREIGN PATENT DOCUMENTS

| | | |
|---|---|---|
| 1201403 | 3/1986 | Canada . |
| 1302937 | 6/1992 | Canada . |
| 1307489 | 9/1992 | Canada . |

*Primary Examiner*—Walter D. Griffin
*Assistant Examiner*—Tam M. Nguyen
*Attorney, Agent, or Firm*—Rodman & Rodman

[57] ABSTRACT

A process and apparatus for treating a crude oil containing water. An inlet introduces a flow of the crude oil into the apparatus, wherein at least a portion of the water is a vapor. A first separator disrupts the crude oil flow in order to separate at least a portion of the vapor from the crude oil to produce a treated oil. A heater heats the treated oil to produce a heated treated oil. Means for recycling a first amount of the heated treated oil from the heater to the inlet are provided. The first amount is at least sufficient to heat the crude oil to a temperature such that at least a portion of the water forms the vapor. At least one oil outlet removes the treated oil and at least one vapor outlet removes the vapor. Finally, means are provided for producing the flow of the crude oil. The process is preferably conducted using the apparatus.

13 Claims, 7 Drawing Sheets

PROCESS FOR REMOVING WATER FROM A WATER-CONTAINING CRUDE OIL

TECHNICAL FIELD

The present invention relates to a process and an apparatus for treating a crude oil containing water to produce a treated oil, and more particularly, for separating the water from the crude oil to produce a dehydrated oil.

BACKGROUND ART

In the treatment of crude oil, it is desirable to dehydrate the crude oil by removing all, or substantially all, of the water mixed with or entrained in the crude oil. Conventionally, the water is removed from the crude oil simply by heating the crude oil in a vessel, such as a storage tank or horizontal pressure vessel, in order to settle the water by gravity out of the crude oil. More recently, apparatus have been developed that simply heat the crude oil, in order to boil the water therein. These apparatus typically result in the undesirable formation of large quantities of a foam comprised of steam bubbles in an oil film. Large quantities of crude oil foam present difficulties with respect to both the heating and processing of the crude oil.

As a result, several apparatuses have been developed in an attempt to treat the crude oil, to remove the water, without causing a substantial amount of foaming. For instance, Canadian Patent No. 1,201,403 issued Mar. 4, 1986 to Murphy Oil Company Limited is directed at an apparatus which includes a heat exchanger, separate from and external to a separation vessel, for preheating the crude oil before it enters the separation vessel. The heat exchanger, which is comprised of a relatively complex glycol heat exchanger, is designed to pre-heat the stream to a temperature which is at least the boiling temperature of water at atmospheric conditions. Thus, two separate devices, being the heat exchanger and the separator, are required. Further, it has been found that the components may not have a satisfactory throughput of crude oil for their relative size and cost. Accordingly, this apparatus may not be particularly cost effective, efficient or desirable for use in treating crude oil.

Reissued Canadian Patent No. 1,302,937 issued Jun. 9, 1992 to Colt Engineering Corporation is directed at an apparatus which includes dehydrator means for receiving the crude oil and producing the dehydrated oil and heater means for maintaining the liquid in the dehydrator means at an elevated distillation temperature such that the dehydrated oil may be produced. The apparatus may further include means for recycling a portion of the dehydrated oil to spray means. The patent states that the spray means are designed to spray the recycled dehydrated oil into the dehydrator means in order to suppress any foam on the surface of the liquid in the dehydrator means. Thus, the primary purpose of the recycling means is foam suppression. However, the patent does indicate that the incoming dehydrated oil is sprayed onto the surface of the liquid in heat exchange contact with the surface of the already heated oil in the dehydrator means. Thus, although this is clearly not the primary purpose, there may be some heat exchange as a result of the recycling means. However, any heating by the recycling means is clearly secondary or supplementary to the heater means only.

Finally, Canadian Patent No. 1,307,489 issued Sep. 15, 1992 to HTI Technology Canada Ltd. is also directed at an apparatus which recycles a portion of the treated oil back through the apparatus. However, the oil is recycled in order to maintain the flow of the oil through the apparatus and so that additional water may be removed from the recycled oil. There is no specific discussion with respect to recycling of the treated oil in order to suppress foam formation or to heat the untreated oil.

There is therefore a need in the industry for a process and an apparatus for treating a crude oil containing water, such that the water is separated therefrom, to produce a treated oil. Further, there is a need for a process and an apparatus which minimize foam formation and treat the crude oil in a relatively energy efficient manner compared to known processes and apparatuses. As well, there is a need for a process and an apparatus which recycle an amount of the treated oil, for mixing with the untreated crude oil, in order that the treated oil heats the untreated crude oil to a temperature such that substantially all the water contained in the crude oil forms a vapour which may be separated from the crude oil. Further, the process and the apparatus preferably recycle the treated oil in a manner such that the treated oil and the untreated crude oil are mixed together to vaporize the water therein prior to the mixture entering a separator for separation of the vapour from the crude oil.

DISCLOSURE OF INVENTION

The present invention relates to a process and an apparatus for treating a crude oil containing water such that the water is separated therefrom to produce a treated oil. Further, the invention relates to a process and an apparatus which are relatively energy efficient and which minimize foam formation. As well, the invention relates to a process and an apparatus which recycle an amount of the treated oil, for mixing with the untreated crude oil, in order that the treated oil may heat the untreated crude oil to a temperature such that substantially all the water contained in the crude oil forms a vapour. The vapour may then be separated from the crude oil by a separator, thus producing the treated oil. Further, the invention relates to a process and an apparatus which preferably recycle the treated oil in a manner such that the treated oil and the untreated crude oil are mixed together prior to entering the separator.

In an apparatus form of the invention, the invention is comprised of an apparatus for treating a crude oil containing water, the apparatus comprising:

(a) an inlet for introducing a flow of the crude oil into the apparatus wherein at least a portion of the water contained in the crude oil is a vapour;

(b) a first separator, communicating with the inlet, for disrupting the flow of the crude oil in order to separate at least a portion of the vapour from the crude oil to produce a treated oil;

(c) a heater, communicating with the separator, for heating the treated oil to produce a heated treated oil;

(d) means for recycling a first amount of the heated treated oil from the heater to the inlet for mixing with the crude oil, wherein the first amount of the heated treated oil is at least sufficient to heat the crude oil to a temperature such that at least a portion of the water contained in the crude oil forms the vapour;

(e) at least one oil outlet for removing a second amount of the heated treated oil from the apparatus for further processing or storage;

(f) at least one vapour outlet for removing the vapour from the apparatus for further processing or storage; and (g) means for producing the flow of the crude oil through the apparatus.

Preferably, the apparatus further comprises a second separator, communicating with the heater, for disrupting the flow of the heated treated oil in order to separate at least a further portion of the vapor from the heated treated oil, wherein the recycling means recycles the first amount of the heated treated oil from the second separator to the inlet. As well, the apparatus preferably further comprises a storage section, communicating with the second separator, for containing the heated treated oil passing through the second separator.

Preferably, the heater heats the treated oil to a temperature such that upon the mixing of the first amount of the heated treated oil with the crude oil at the inlet, at least a portion of the water contained in the crude oil forms the vapor. In the preferred embodiment, substantially all of the water contained in the crude oil forms the vapour.

More particularly, the heater preferably heats the treated oil to a temperature of greater than or equal to the boiling point of the water in the crude oil. In the preferred embodiment, the heater heats the treated oil to a temperature of between about 135 and 150 degrees Celsius. However, the required temperature of the treated oil needed to achieve the desired result, as indicated herein, may vary depending upon other factors such as the pressure within the apparatus.

Further, as indicated, preferably substantially all of the water in the crude oil forms the vapour upon mixing with the first amount of the heated treated oil. Accordingly, in the preferred embodiment, the first amount of the recycled heated treated oil is at least sufficient to heat the crude oil to a temperature of greater than or equal to about 105 degrees Celsius. However, the temperature of the crude oil required to achieve the desired result, as described herein, may vary depending upon other factors such as the pressure of the apparatus. In addition, the actual amount of the first amount of the recycled heated treated oil required to be mixed with the crude oil to achieve the desired result may vary depending upon such factors as the temperature of the heated treated oil and the flow rate and temperature of the crude oil through the inlet.

Each of the first separator, the heater and the second separator may be self-contained as distinct or separate units. Similarly, the storage section may be self-contained as a distinct or separate unit. However, preferably, the apparatus is comprised of a vessel such that the first separator, the heater and the second separator are contained therein. Similarly, where the apparatus includes a storage section, the apparatus is preferably comprised of a vessel such that the first separator, the heater, the second separator and the storage section are contained therein.

In the preferred embodiment, the recycling means is comprised of at least one conduit for conducting the first amount of the heated treated oil therethrough. Further, in the preferred embodiment, the inlet is comprised of a conduit for creating a turbulent flow such that the first amount of the recycled heated treated oil is mixed with the crude oil therein. However, the inlet may be comprised of any means, device, structure, apparatus or mechanism suitable for, and capable of, mixing the first amount of the heated treated oil and the crude oil therein.

The first and the second separators may each be comprised of any means, device, structure, mechanism or apparatus for disrupting the flow of the crude oil and the heated treated oil respectively in order to separate the vapour. However, preferably, each of the first and second separators are comprised of a packing material for disrupting the flow. Any conventional packing material may be used. In the preferred embodiment, the packing material is comprised of a plurality of pall rings.

The heater may be comprised of any conventional heater or heating device capable of heating the treated oil to the desired temperature. Preferably, the heater is comprised of at least one fire tube extending through substantially the entire heater for heating the treated oil. In addition, the heater is preferably comprised of at least one baffle for inhibiting channel flow or channeling or foam formation in the heater. Although any conventional baffle may be used, in the preferred embodiment, the baffle is comprised of a hydronetic baffle.

In a process form of the invention, the invention is comprised of a process for treating a flow of crude oil containing water through an apparatus having an inlet, the process comprising the steps of:

(a) introducing the flow of the crude oil into the apparatus at the inlet, wherein at least a portion of the water contained in the crude oil is a vapour;

(b) first disrupting the flow of the crude oil in order to separate at least a portion of the vapour from the crude oil to produce a treated oil;

(c) heating the treated oil to produce a heated treated oil; and (d) recycling a first amount of the heated treated oil to the inlet for mixing with the crude oil, wherein the first amount of the heated treated oil is at least sufficient to heat the crude oil to a temperature such that at least a portion of the water contained in the crude oil forms the vapour.

Preferably, the process further comprises the step of removing a second amount of the heated treated oil from the apparatus for further processing or storage. In addition, the process further preferably comprises the step of removing the vapour from the apparatus for further processing or storage. As well, the process further preferably comprises the step of second disrupting the flow of the heated treated oil, prior to the recycling step, in order to separate at least a further portion of the vapor from the heated treated oil. Finally, the process further preferably comprises the step of inhibiting channeling or the formation of foam during the heating step.

The heating step is preferably comprised of heating the treated oil to a temperature such that upon the mixing of the first amount of the heated treated oil with the crude oil at the inlet, at least a portion of the water contained in the crude oil forms the vapor. In the preferred embodiment, substantially all of the water contained in the crude oil forms the vapour.

More particularly, the heating step is preferably comprised of heating the treated oil to a temperature of greater than or equal to the boiling point of the water in the crude oil. In the preferred embodiment, the heating step is comprised of heating the treated oil to a temperature of between about 135 and 150 degrees Celsius.

As indicated, preferably substantially all of the water in the crude oil forms the vapour upon mixing with the first amount of the heated treated oil. Accordingly, in the preferred embodiment, the first amount of the heated treated oil recycled by the recycling step is at least sufficient to heat the crude oil to a temperature of greater than or equal to about 105 degrees Celsius.

The individual steps of the process, as well as the overall process, may be conducted at a pressure below, at or above atmospheric pressure, as desired. For instance, at least the heating step may be conducted at a pressure below atmospheric pressure. However, preferably, at least the first disrupting step, the heating step and the second disrupting step are conducted at a pressure of about equal to or greater than atmospheric pressure. In the preferred embodiment, at least the first disrupting step, the heating step and the second disrupting step are conducted at a pressure of between about 2 and 5 psig.

Finally, in the preferred embodiment, the process is performed using the apparatus form of the invention. However, any other suitable apparatus may be used.

BRIEF DESCRIPTION OF DRAWINGS

Embodiments of the invention will now be described with reference to the accompanying drawings, in which.

BEST MODE OF CARRYING OUT INVENTION

The within invention is comprised of both a process and an apparatus (20) for treating a crude oil (21), and preferably, a heavy hydrocarbon crude oil. The crude oil (21) is comprised of hydrocarbons, water and solids. The solids may include particles of clays, metals, silicates (such as sand and silt) and other solid matter. The water is typically mixed with, or entrained in, the hydrocarbons to form the crude oil (21).

The apparatus (20) may be used in isolation for the treatment of untreated crude oil. However, preferably, the apparatus (20) is used in combination with a conventional gravity separator treating system or other known treating system for removing a portion of the water in the crude oil (21). Thus, the apparatus (20) is preferably used to treat crude oil (21) which has already been partially treated, preferably by a gravity separator treating system, in order to remove a portion of the water.

Figure 1:
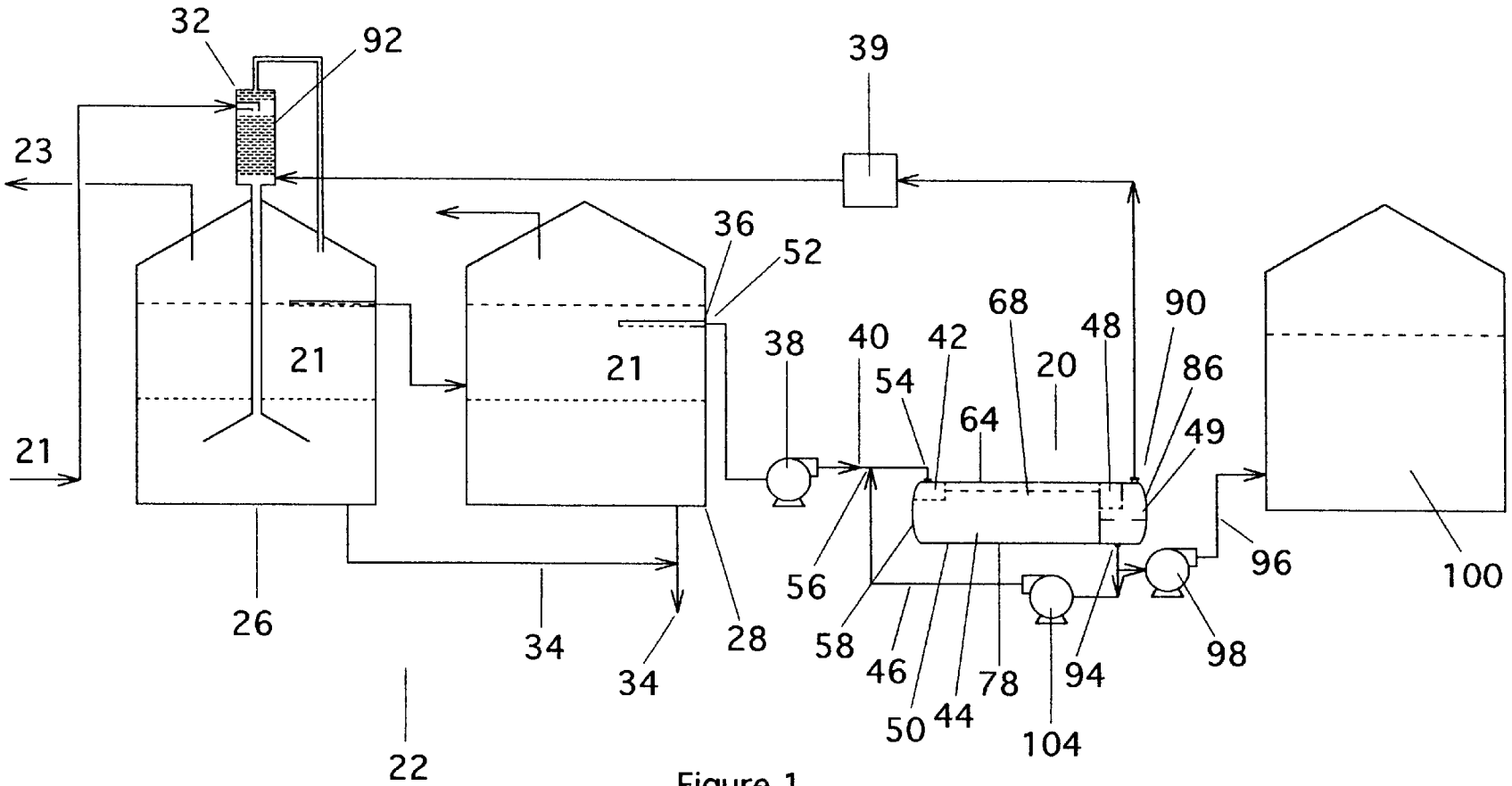
FIG. 1 is a schematic representation of a preferred embodiment of the apparatus in use with an atmospheric gravity treating system.
Figure 2:
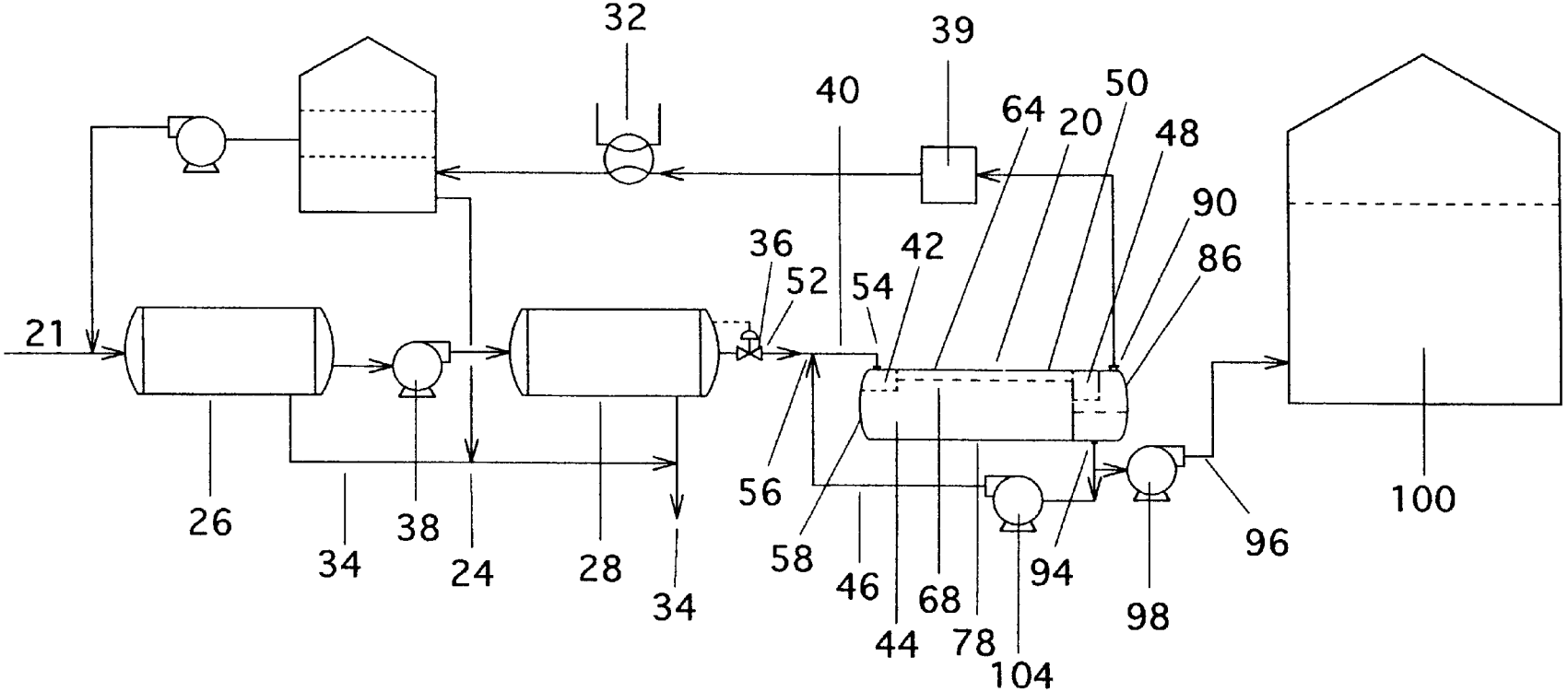
FIG. 2 is a schematic representation of the preferred embodiment of the apparatus in use with a pressure gravity treating system.
Figure 3:
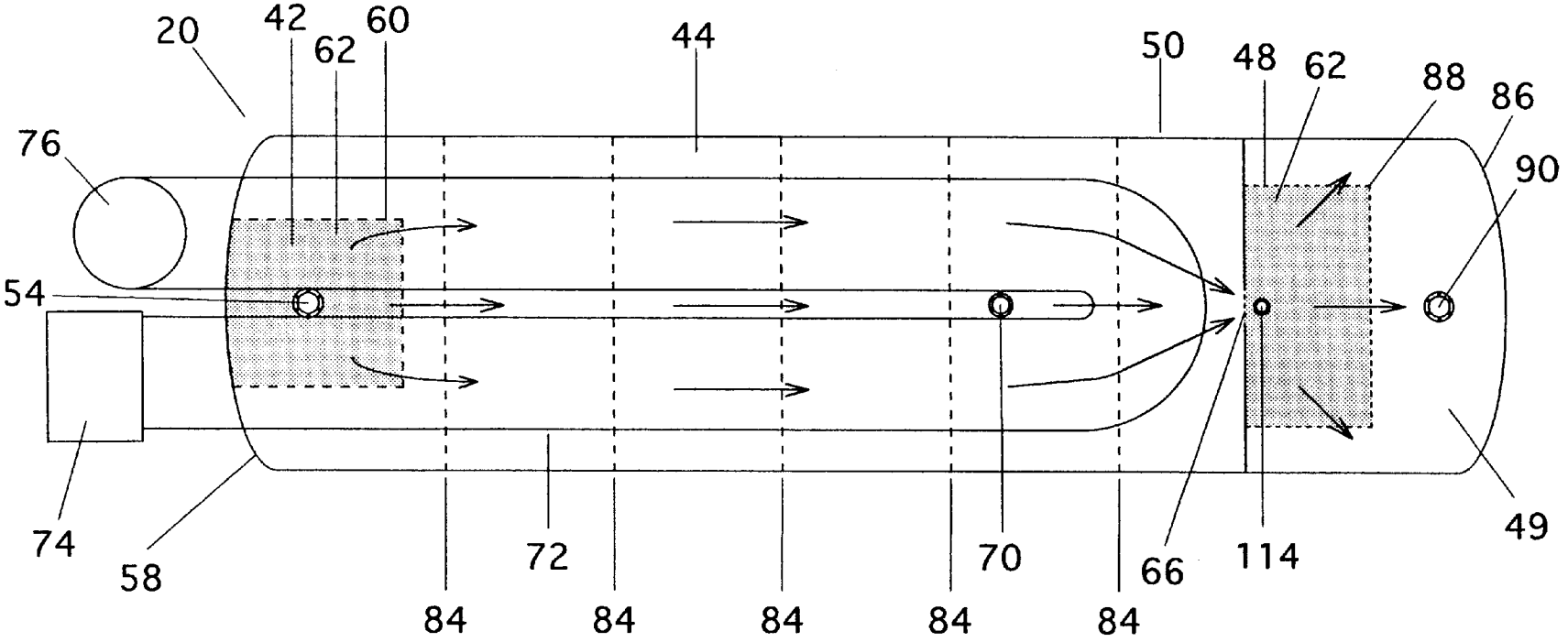
FIG. 3 is a schematic representation of a top view of the apparatus shown in FIGS. 1 and 2.

Any conventional gravity separator treating system may be used with the apparatus (20). For instance, as shown in FIGS. 1 and 2 respectively, the apparatus (20) may be used to treat the crude oil (21) subsequent to treatment by an atmospheric gravity treating system (22) or a pressure gravity treating system (24). Each of these systems (22, 24) includes a free water knock out (26) for removing a first portion of the water, and a treater (28) for removing a second portion of the water. Each of the free water knock out (26) and the treater (28) permit a portion of the water contained in the crude oil (21) to become separated from the crude oil (21) by gravity so that the water can be removed from the bottoms of each of the free water knock out (26) and the treater (28), while the remaining crude oil (21) is transported for further processing. Thus the crude oil (21) is processed in series in the free water knock out (26), the treater (28) and the apparatus (20) respectively.

In order to facilitate or enhance the separation of the water, the crude oil (21) may be heated within each of the free water knock out (26) and the treater (28). For instance, in conventional treating systems, the crude oil (21) may be heated to increase its temperature and thereby increase the density difference between the crude oil and the water and reduce the viscosity of the crude oil. The water may then settle from the crude oil (21). The specific temperature of the crude oil (21) will vary depending upon whether the system is an atmospheric or a pressure gravity treating system and depending upon the specific pressure in the pressure gravity treating system. Pressure treating systems may operate at a temperature above the boiling point of water without boiling the water.

Any water accumulating at the bottoms of the free water knock out (26) or the treater (28) is discharged by a water line (34). Following processing in the free water knockout (26), the crude oil (21) is directed into the treater (28) for further processing therein. Following processing of the crude oil (21) in the treater (28), the crude oil (21) is directed out of the treater (28) and to the apparatus (20) through a gravity separator dump valve (36). The crude oil (21) is caused to flow through the atmospheric and pressure gravity treating systems (22, 24), by one or more pumps (38) and the overall pressure of the systems.

The apparatus (20) is comprised of means for producing a flow of the crude oil (21) through the apparatus (20). The flow producing means may be comprised of one or more conventional devices, apparatuses or processes for producing a fluid flow which are compatible with the intended use, and in particular, use with crude oil (21). Further, the flow producing means is compatible with, and may be determined by, the particular gravity treating system (22, 24) being used with the apparatus (20). For instance, where the apparatus (20) is used in combination with an atmospheric gravity treating system (22) or the apparatus (20) is used in isolation, the flow producing means is preferably comprised of at least one pump (38) for pumping the crude oil (21) through the apparatus (20). Where the apparatus (20) is used in combination with a pressure gravity treating system (24), the flow producing means is preferably comprised of a system or device or devices for maintaining or retaining at least an amount of the pressure from the pressurized system (24), as the crude oil (21) exits the pressurized system (24) and enters the apparatus (20), such that the pressure drives or propels the crude oil (21) through the apparatus (20). In other words, the crude oil (21) is discharged through the dump valve (36) at a sufficient pressure to produce the flow of the crude oil (21) through the apparatus (20). However, where necessary, one or more supplemental pumps may be used to assist or enhance the flow of the crude oil (21) through the apparatus (20).

In the preferred embodiment, the apparatus (20) is further comprised of an inlet (40), a first separator (42) and a heater (44). The inlet (40) introduces or conducts the flow of the crude oil (21) into the apparatus (20), and specifically, into the first separator (42). Thus, the inlet (40) communicates with the first separator (42) which produces the treated oil (45) by separating the water, in the form of a vapour (29), therefrom. The first separator (42) also communicates with the heater (44) such that the treated oil (45) and the separated vapour (29) may pass from the first separator (42) into the heater (44).

Further, the apparatus (20) is comprised of means for recycling an amount of the treated oil (45) to the inlet (40). Any conventional means, devices or processes for recycling an amount of the treated oil (45) to the inlet (40) may be used, however, in the preferred embodiment, the recycling means are comprised of a recycling line (46). The recycling line (46) may extend directly from the heater (44) to the inlet (40). However, in the preferred embodiment, the apparatus (20) is further comprised of a second separator (48) and a storage section (49). In this case, as discussed further below, the recycling line (46) extends from the storage section (49) to the inlet (40).

The apparatus (20) may operate below, at or above atmospheric pressure. Where the apparatus (20) is pressurized, the pressure of the apparatus (20) is preferably relatively low. In the preferred embodiment, the apparatus (20) has a pressure in the range of about 2 to 5 psig. The pressure of the crude oil (21) leaving the gravity treating systems (22, 24) through the gravity separator dump valve (36) will drop from the pressure in the gravity treating systems (22, 24) to the pressure in the apparatus (20) upon flowing through the dump valve (36). If the temperature of the crude oil (21) discharging from the gravity treating systems (22, 24) is above 100 degrees Celsius, the water and a small fraction of hydrocarbon light ends in the crude oil (21) may flash to form a vapour (29) when depressurized. This may result in the temperature of the crude oil (21) dropping as low as 100 degrees Celsius. A higher water content in the crude oil (21) will typically result in lower temperatures.

In the preferred embodiment, the first separator (42), the heater (44), the second separator (48) and the storage section (49) are all contained within a vessel (50) so that a single treating unit is formed. However, each of the first separator (42), the heater (44), the second separator (48) and the storage section (49) may be self-contained as distinct or separate units if desired. The vessel is preferably cylindrical, having a first end (58), a second end (86), a top (64) and a bottom (78). However, the vessel (50) may have any shape or configuration compatible with the intended use of the apparatus (20). The vessel (50) may be comprised of any material compatible with the use of the vessel (50) and the apparatus (20), as described herein, and which is capable of withstanding the temperature and the pressure of the crude oil (21) and treated oil (45) therein. Further, preferably, the vessel (50) is insulated in order to minimize any heat loss from the crude oil (21) or the treated oil (45) contained therein.

As indicated, the crude oil (21) entering the inlet (40) from the gravity treating systems (22, 24) may have already been heated to above 100 degrees Celsius. However, the temperature of the crude oil (21) typically drops as it enters the inlet (40). Once in the inlet (40), the temperature of the crude oil (21) is increased by the supply of an amount of recycled treated oil (45) to the inlet (40) by the recycling line (46), as further described below. Thus, the inlet (40) contains a mixture of the crude oil (21) from the gravity treating systems (22, 24), and the recycled treated oil (45) from the recycling line (46). The treated oil (45) is heated in the heater (44) so that the treated oil (45) from the recycling line (46) is at a sufficient temperature to heat the crude oil (21) to the necessary temperature to boil the water therein. In the preferred embodiment, the treated oil (45) is at a temperature of about 135 degrees Celsius to 150 degrees Celsius.

A sufficient amount of the treated oil (45) is mixed with the crude oil (21) to increase the temperature of the crude oil (21) in the inlet (40) to a temperature such that substantially all of the water contained in the crude oil (21) is heated to its boiling point in order to form a vapour (29). Preferably, substantially all of the water in the crude oil (21) forms a vapour (29) prior to the crude oil (21) entering the first separator (42). Thus, in the preferred embodiment at a pressure of about 2 to 5 psig, a sufficient amount of treated oil (45) is mixed with the crude oil (21) to increase the temperature of the crude oil (21) to at least about 105 degrees Celsius. However, the temperature of the crude oil (21) required to achieve the desired results will vary depending upon the pressure of the apparatus (20). Further, the actual amount of recycled treated oil (45) required to be mixed with the crude oil (21) to achieve the desired result will vary depending upon the temperature of the treated oil (45) and the flow rate of the crude oil (21) through the inlet (40).

The inlet (40) may be comprised of any suitable pipe or conduit for conducting or introducing the crude oil (21) to the first separator (42) of the apparatus (20). The dimensions and configuration of the inlet (40) are chosen so that the crude oil (21) and treated oil (45) flow therethrough relatively unimpeded. Further, the inlet (40) must have the necessary capacity and shape to permit the crude oil (21) to mix with the recycled treated oil (45) therein. Although the crude and treated oils (21, 45) may be mixed by any conventional devices or processes for mixing, the oils (21, 45) are preferably mixed by a turbulent flow of the oils (21, 45) through the inlet (40). Further, the inlet (40) is preferably insulated to minimize any heat loss from the inlet (40) and is comprised of a material suitable for the purpose and able to withstand the temperature and pressure of the crude oil (21) and treated oil (45) within the inlet (40).

In the preferred embodiment, the inlet (40) is comprised of a first end (52) for communicating with the gravity treating systems (22, 24) or other source of the crude oil (21), and a second end (54) for communicating with the first separator (42). Further, as indicated, the inlet (40) includes a connection (56) to the recycling line (46). Any manner or form of communication between the adjacent parts of the apparatus (20) at the first end (52), the second end (54) and the connection (56) may be used which permits the crude oil (21) and the treated oil (45) to flow into and between the parts of the apparatus (20) relatively unimpeded.

The first separator (42) is preferably located in the apparatus (20) between the inlet (40) and the heater (44) such that the crude oil (21) flows therethrough from the inlet (40) to the heater (44). In the preferred embodiment, in which the first separator (42) and the heater (44) are contained within the vessel (50), the first separator (42) is preferably located adjacent the first end (58) of the vessel (50) and is in communication with the second end (54) of the inlet (40). The heater (44) is located within the vessel (50) adjacent to, and in communication with, the first separator (42).

The first separator (42) may be comprised of any means, device or apparatus for disrupting the flow of the crude oil (21) therethrough in order to separate the vapour (29), and the separation may be achieved by any conventional separation process. In the preferred embodiment, the first separator (42) is comprised of a conventional separator for separating the vapour (29) mixed with or entrained within the crude oil (21). Further, the first separator (42) is comprised of a screened, or other flow-through, compartment (60) which permits the crude oil (21) to flow therethrough. In the preferred embodiment, the compartment (60) is about 28 inches in depth, 4 feet long and 4 feet wide. Preferably, the compartment (60) contains a packing material (62) for disrupting the flow of the crude oil (21) through the compartment (60). The packing material (62) may be any conventional packing material which allows the crude oil (21) to flow therethrough, while creating a tortuous flow path which disrupts the flow of the crude oil (21) sufficiently to release the vapour (29). Thus, the packing material (62) preferably provides a relatively large surface area.

As stated, any packing material (62) may be used which is capable of facilitating the separation of the vapour (29) from the remainder of the crude oil (21) at a wide range of flow rates of the crude oil (21) through the compartment (60). Further, the specific packing material (62) should be selected so that it is compatible with the crude oil (21) and so that the flow disruption effect caused by it does not result in an excessive pressure drop of the crude oil (21) such that the flow of the crude oil (21) is substantially impeded. Any suitable configuration of the packing material (62), having a relatively large surface area, may be used, including broken solids, shaped packings and grids. For example, rasching rings, lessing rings, berl saddles, intalox saddles, tellerettes or pall rings may be used. These packings may be comprised of any material suitable for the purpose such as steel, ceramics or polypropylene. In selecting the type, configuration and specific dimensions of the packing material (62) to be used, some of the factors to be considered are as follows: the length and overall dimensions of the compartment (60); the amount and size of any solids in the crude oil, so that any plugging by the solids is minimized, and any other characteristics of the crude oil (21); the acceptable pressure drop as the crude oil (21) passes through the packing material (62); the flow rate of the crude oil (21) through the compartment (60); and the ability to pack the material to provide good packing characteristics.

In the preferred embodiment, the packing material (62) is comprised of a plurality of pall rings. As the crude oil (21) flows through the compartment (60) and the pall rings, the velocity of the crude oil (21) is reduced and the vapour (29) is separated from the remainder of the crude oil (21) to produce the treated oil (45). The vapour (29) and the treated oil (45) are then permitted to flow out of the compartment (60) and into the heater (44).

As the vapour (29) enters the heater (44) from the compartment (60), the vapour (29) rises to the top of the heater (44), being the top (64) of the vessel (50) in the preferred embodiment. The vapour (29) then flows along a flow path in the heater (44) parallel to the top (64) of the vessel (50) towards a heater outlet (66) located adjacent the top (64) of the vessel (50). In the preferred embodiment, the vapour (29) travels within the uppermost 14 inches of the vessel (50) above the treated oil (45). Thus, a liquid line (68) is formed between the treated oil (45) and the vapour (29). The level of the liquid line (68) in the vessel (50), and particularly in the heater (44), will vary depending primarily upon the relative amounts of vapour (29) and treated oil (45) flowing into and out of the heater (44) and the flow rate through the heater (44).

The heater (44) is comprised of any conventional heater or heating device which is capable of heating the treated oil (45) to the desired temperature within the heater (44), as discussed above. The treated oil (45) is heated within the heater (44) primarily for two purposes. First, the treated oil (45) within the heater (44) is heated to the preferred temperature of about 135 degrees Celsius to 150 degrees Celsius, for recycling through the recycling line (46) to the inlet (40), in order to elevate the temperature of the crude oil (21) in the inlet (40) such that the temperature of the water in the crude oil (21) is raised to its boiling point to form the vapour (29). Second, although preferably substantially all of the water in the crude oil (21) has already been vaporized, the heating of the treated oil (45) in the heater (44) may vaporize any water which remains in the treated oil (45). Any further vapour (29) formed in the heater (44) similarly rises to the top (64) of the vessel (50) and flows towards the heater outlet (66). Preferably, a pressure relief valve (70) is located adjacent the top (64) of the vessel (50) in communication with the heater (44) in order that any excess pressure in the heater (44) may be relieved. As stated above, the required temperature of the treated oil (45) to achieve these desired results will vary depending upon the pressure of the apparatus (20). For instance, where the apparatus (20), and in particular the vessel (50), are at a pressure below atmospheric pressure, the required temperature of the treated oil (45) in order to form the vapour (29) will be reduced.

Although any conventional heater, heating apparatus or heating process may be used to heat the treated oil (45) in the heater (44), preferably the heater (44) is comprised of a fire tube (72). Preferably, the fire tube (72) extends from the first end (58) of the vessel (50), into the vessel (50), and through substantially the entire length of the heater (44). Further, the fire tube (72) is preferably centrally located within the vessel (50), and in particular, within the heater (44). As well, the fire tube (72) is preferably located such that the fire tube (72) is below the liquid line (68) during normal operation of the apparatus (20) so that the fire tube (72) remains completely submersed in the treated oil (45) during operations. Further, in the preferred embodiment, the fire tube (72) is generally U-shaped. Fuel is introduced into the fire tube (72) at an inlet end (74) and is burned. Exhaust from the fire tube (72) is discharged to the atmosphere through a vertical discharge end (76). Thus, as the treated oil (45) flows from the first separator (42) and through the heater (44) towards the heater outlet (66), the treated oil (45) flows along the length of the fire tube (72)and is heated to the preferred temperature of about 135 degree Celsius to 150 degrees Celsius.

In the preferred embodiment, a conventional temperature indicating transmitter (not shown) senses the temperature of the treated oil (45) in the heater (44) and controls the firing of the fire tube (72). Thus, the temperature of the treated oil (45) in the heater (44) can be controlled to maintain it within the desired temperature range.

As the treated oil (45) flows through the heater (44), the solids contained in the treated oil (45) typically settle towards the bottom of the heater (44), being the bottom (78) of the vessel (50) in the preferred embodiment. Preferably, a drain pan (80) is located within the heater (44) adjacent the bottom (78) of the vessel (50). The solids are permitted to flow or drain into the drain pan (80), and are then directed out of the drain pan (80) through a drain pan outlet (82). The specific mechanism for draining the solids is discussed further below.

Finally, in the event any foaming occurs within the heater (44), the heater (44) may be comprised of one or more foam breaker demisters (84). In the preferred embodiment, the foam breaker demisters (84) are comprised of a plurality of hydronetic baffles, however, any device, apparatus or process for minimizing or suppressing foam formation in the heater (44) may be used. Where the foam breaker demisters (84) are comprised of the hydronetic baffles, the baffles are spaced at approximately five foot intervals between the first end (58) of the vessel (50) and the heater outlet (66). Further, each baffle extends from the top (64) to the bottom (78) of the vessel (50) so that the baffles extend across substantially the entire treated oil (45) and vapour (29) flow path. As indicated, the baffles prevent channeling of the treated oil (45) from the first separator (42) to the heater outlet (66) and break down any foam created along the flow path through the heater (44). It has been found that the use of the foam breaker demisters (84) in combination with the large volume of treated oil (45) which may be contained within the heater (44) and the recycling of the treated oil (45) permit the apparatus (20) to handle substantial slugs of water and wet emulsions.

Once the treated oil (45) and the vapour (29) flow through the heater (44), they are preferably permitted to pass through the heater outlet (66) and into the second separator (48). The second separator (48) is preferably located adjacent to the heater (44) and in communication with the heater outlet (66) such that the vapour (29) and all, or a substantial portion, of the treated oil (45) may flow from the heater (44) and through the second separator (48). Where substantially all of the water contained within the crude oil (21) has been previously vaporized and separated from the crude oil (21) by the first separator (42), the second separator (48) may not be necessary. However, preferably, the apparatus (20) is comprised of the second separator (48) for separating any vapour (29) formed during the heating of the treated oil (45) in the heater (44) and for cleaning the solids in the treated oil (45) in the manner described below.

As indicated previously, the second separator (48) is preferably contained within the vessel (50) between the heater (44) and the second end (86) of the vessel (50). The second separator (48) is comprised of a compartment (88) containing a packing material (62) similar to that of the first separator (42). In the preferred embodiment, the screened or flow-through compartment (88) of the second separator (48) is about three feet in depth, three feet long and three feet wide and is packed with a plurality of pall rings. The vapour (29) and the treated oil (45) flow through the pall rings, which provide a large surface area in order to facilitate the separation of the vapour (29) from the treated oil (45) and the demisting of the vapour (29).

Figure 4:
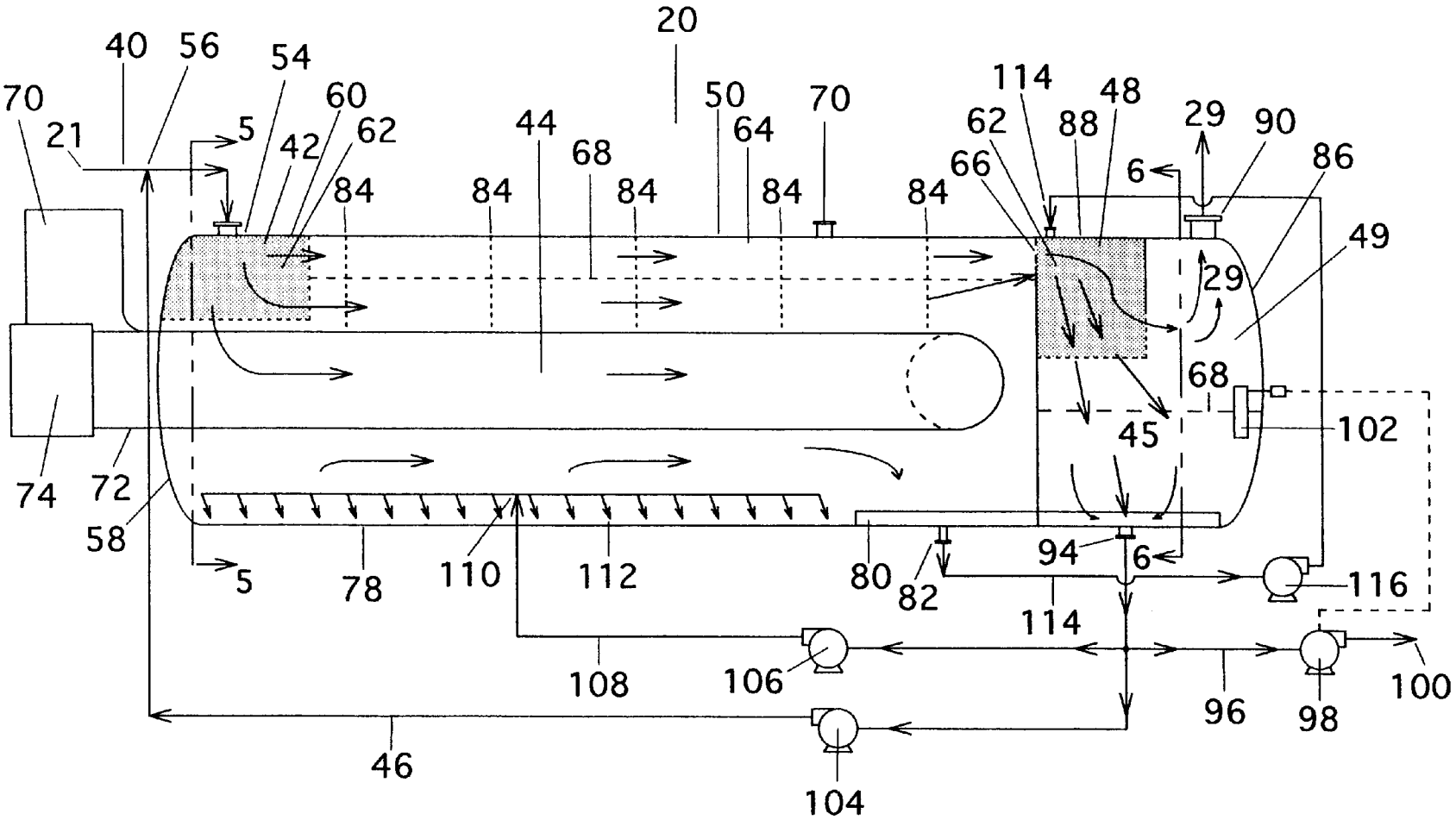
FIG. 4 is a detailed schematic representation of a side view of the apparatus shown in FIGS. 1 and 2, showing the flow of a vapor and a treated oil therein.
Figure 5:
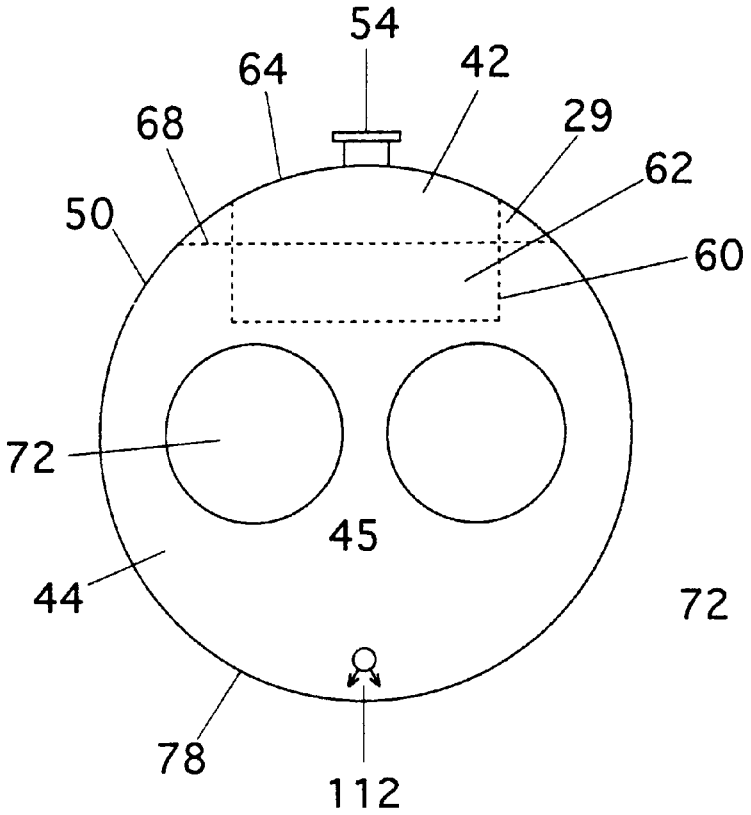
FIG. 5 is a cross-section of the apparatus of FIG. 4 taken along lines 5—5.
Figure 6:
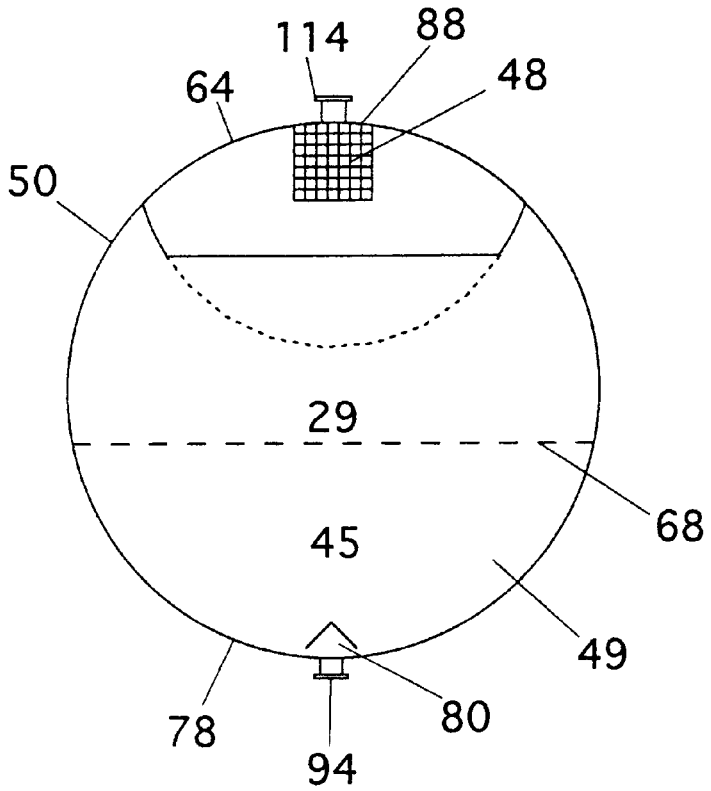
FIG. 6 is a cross-section of the apparatus of FIG. 4 taken along lines 6—6.
Figures 7, 8:
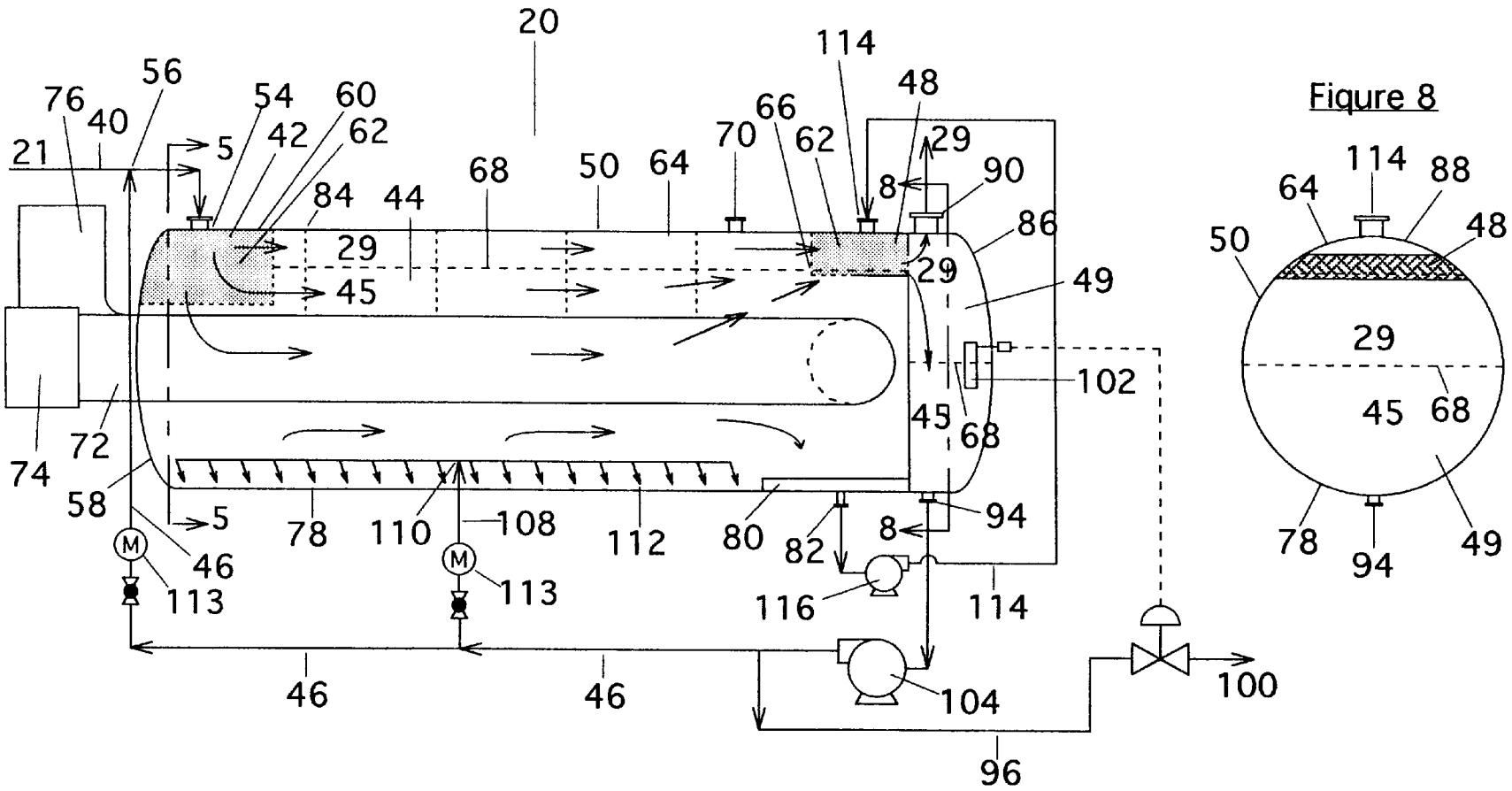
FIG. 7 is a detailed schematic representation of a side view of a first alternate embodiment of the apparatus, showing the flow of a vapor and a treated oil therein.
FIG. 8 is a cross-section of the apparatus of FIG. 7 taken along lines 8—8.
Figure 10:
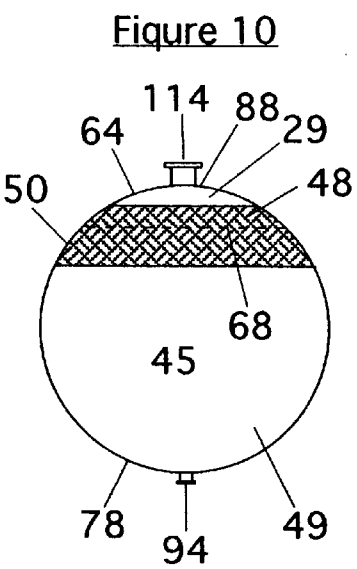
FIG. 10 is a cross-section of the apparatus of FIG. 9 taken along lines 10—10.
Figure 9:
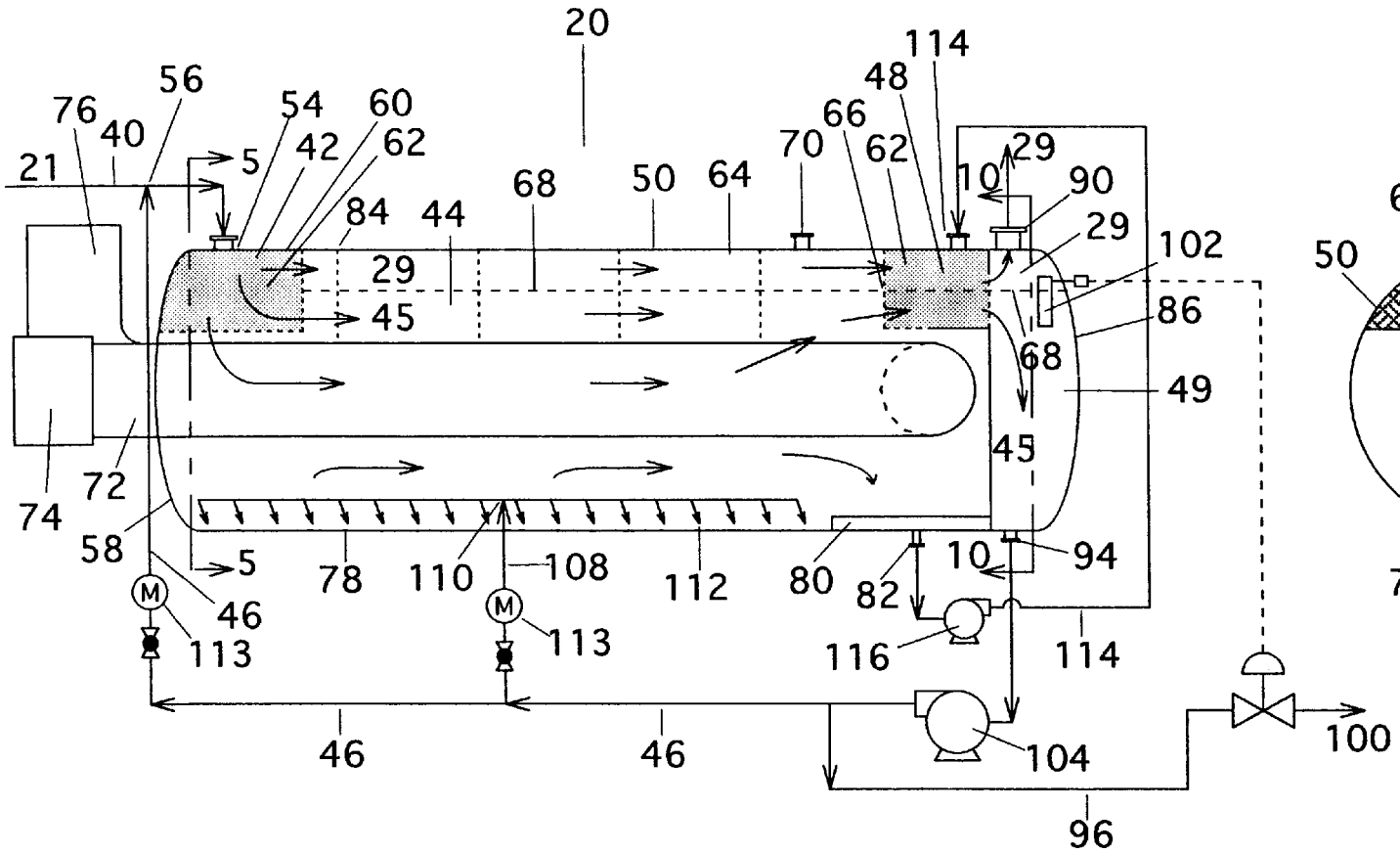
FIG. 9 is a detailed schematic representation of a side view of a second alternate embodiment of the apparatus, showing the flow of a vapor and a treated oil therein.

Once the vapour (29) and the treated oil (45) flow through the second separator (48), they are permitted to pass into the storage section (49) of the apparatus (20). Preferably, the storage section (49) is also contained within the vessel (50) between the heater (44) and the second end (86) of the vessel (50) and is in communication with the second separator (48). The storage section (49) permits the vapour (29) to rise towards the top of the storage section (49), being the top (64) of the vessel (50) in the preferred embodiment, and towards a vapour outlet (90). The second separator (48) and the storage section (49) may have any dimensions and have any configuration relative to each other which permit the second separator (48) and the storage section (49) to perform their relative functions as described herein. For instance, various configurations of the second separator (48) and the storage section (49) are shown in FIGS. 4, 7 and 9.

The vapour outlet (90) is preferably located at the top (64) of the vessel (50), adjacent its second end (86), and is in communication with the storage section (49). The vapour (29) discharged from the vapour outlet (90) is either directed to the flare stack (33) for flaring or to a vapour condenser (32) for recovery of the water and any light hydrocarbon oils which have been vaporized. Where desired, or otherwise required for the operation of the apparatus (20), a vacuum pump (39), as shown in FIGS. 1 and 2, may be connected to the vapour outlet (90). The vacuum pump (39) assists with the evacuation of the vapour (29) from the vessel (50). In addition, the vacuum pump (39) may be used to reduce the pressure in the vessel (50) to below atmospheric pressure.

In the preferred embodiment, as is shown in FIG. 1, the vapour (29) is conducted to a vapour condenser (32) which is comprised of a splash tower (92). The vapour (29) is percolated upwards through the splash tower (92). At the same time, untreated crude oil (21) flows downwards through the splash tower (92) in the opposite direction of the vapour (29). As a result, heat is transferred from the vapour (29) to the crude oil (21) which causes the condensation of the vapour (29). The condensates are then permitted to mix with the crude oil (21) in the gravity treating system (22).

The storage section (49) also communicates with the bottom (78) of the vessel (50), and specifically with an oil outlet (94) at the bottom (78), in order to permit the treated oil (45) to flow out of the vessel (50). Preferably, the oil outlet (94) is located at the bottom (78) of the vessel (50) adjacent the second end (86) of the vessel (50). The treated oil (45) discharged through the oil outlet (94) is then permitted to flow along three flow paths. A first portion of the treated oil (45) is pumped along a first flow path through a clean oil line (96) by a clean oil pump (98) to a clean oil storage tank (100). The operation of the clean oil pump (98) is controlled by a level controller (102) associated with the storage section (49) such that it can monitor and control the amount of treated oil (45) retained within the storage section (49).

A second portion of the treated oil (45) is directed along a second flow path into the recycling line (46) on a continuous basis and is continuously pumped through the recycling line (46) by a recycle pump (104). The recycle pump (104) causes the treated oil (45) to flow from the oil outlet (94), through the recycling line (46), to the connection (56) to the inlet (40). The amount of the treated oil (45) which is recycled through the recycling line (46) is an amount which is at least sufficient to heat the untreated crude oil (21) in the inlet (40) to a temperature such that substantially all of the water contained in the untreated crude oil (21) forms the vapour (29).

Finally, a third portion of the treated oil (45) is continuously recycled along a third flow path to the bottom of the heater (44), by a solids agitate pump, (106) through a first solids line (108). A discharge end (110) of the first solids line (108) is located within the heater (44) adjacent the bottom (78) of the vessel (50) and communicates with a plurality of spray nozzles (112). The spray nozzles (112) are arranged parallel to, and a spaced distance from, the bottom of the heater (44). Further, the spray nozzles (112) are aligned in a direction such that the treated oil (45) discharged from the spray nozzles (112) flows in the direction of the drain pan (80). As a result, the treated oil (45) directed out of the spray nozzles (112) sweeps any solids which have settled at the bottom of the heater (44) towards the drain pan (80) for discharge out of the drain pan outlet (82).

In the alternative, as shown in FIGS. 7 and 9, the first solids line (108) may extend from the recycling line (46) to the discharge end (110) within the heater (44). In this case, a conventional metering device (113) is preferably included in the first solids line (108) and in the recycling line (46) downstream of the first solids line (108) for controlling the flow of the heated treated oil through the lines (46, 108). As a result, the use of a separate solids agitate pump (106) may not be necessary. Rather, the use of the recycle pump (104) alone may be sufficient. The clean oil pump (98) is also eliminated and replaced by a control valve. Clean oil line (96) connects downstream of the recycle pump (46).

The drain pan outlet (82) is connected to, and communicates with, a second solids line (114), which in turn communicates with the second separator (48) so that solids discharged out of the drain pan outlet (82) flow through the second solids line (114), by a solids transfer pump (116), to the second separator (48) for passage through the second separator (48). The second solids line (114) communicates with the second separator (48) at a location adjacent the top of the second separator (48) such that the solids discharged from the second solids line (114) into the second separator (48) pass downwards through the second separator (48). The passage of the solids through the second separator (48), at a point where the vapor (29) and the clean oil are discharged into the separator, breaks down and removes any remaining attached treated oil (45) from the solids in order to clean the solids and to enhance the settlement of the solids downstream of the apparatus (20). The disengaged treated oil (45) and solids are then discharged through the oil outlet (94).

The process of the within invention is preferably conducted using the apparatus (20) as described herein.

The embodiments of the invention in which an exclusive property or privilege is claimed are defined as follows:

1. A process for treating a flow of crude oil containing water through an apparatus having an inlet, the process comprising the steps of:

(a) introducing the flow of the crude oil into the apparatus at the inlet, wherein at least a portion of the water contained in the crude oil is a vapour;

(b) first disrupting the flow of the crude oil in order to separate at least a portion of the vapour from the crude oil to produce a treated oil;

(c) heating the treated oil to produce a heated treated oil; and (d) recycling a first amount of the heated treated oil to the inlet for mixing with the crude oil, wherein the first amount of the heated treated oil is at least sufficient to heat the crude oil to a temperature such that at least a portion of the water contained in the crude oil forms the vapour.

2. The process as claimed in claim 1 further comprising the step of second disrupting the flow of the heated treated oil, prior to the recycling step, in order to separate at least a further portion of the vapor from the heated treated oil.

3. The process as claimed in claim 2 wherein the heating step is comprised of heating the treated oil to a temperature such that upon the mixing of the first amount of the heated treated oil with the crude oil at the inlet, at least a portion of the water contained in the crude oil forms the vapor.

4. The process as claimed in claim 3 wherein substantially all of the water contained in the crude oil forms the vapour.

5. The process as claimed in claim 4 wherein the heating step is comprised of heating the treated oil to a temperature of greater than or equal to the boiling point of the water in the crude oil.

6. The process as claimed in claim 5 wherein the heating step is comprised of heating the treated oil to a temperature of between about 135 and 150 degrees Celsius.

7. The process as claimed in claim 5 further comprising the step of removing a second amount of the heated treated oil from the apparatus for further processing or storage.

8. The process as claimed in claim 7 further comprising the step of removing the vapour from the apparatus for further processing or storage.

9. The process as claimed in claim 5 wherein at least the heating step is conducted at a pressure below atmospheric pressure.

10. The process as claimed in claim 5 wherein at least the first disrupting step, the heating step and the second disrupting step are conducted at a pressure of about equal to or greater than atmospheric pressure.

11. The process as claimed in claim 10 wherein at least the first disrupting step, the heating step and the second disrupting step are conducted at a pressure of between about 2 and 5 psig.

12. The process as claimed in claim 5 wherein the first amount of the heated treated oil recycled by the recycling step is at least sufficient to heat the crude oil to a temperature of greater than or equal to about 105 degrees Celsius.

13. The process as claimed in claim 5 further comprising the step of inhibiting channeling and the formation of foam during the heating step.

* * * * *